US006224647B1

(12) United States Patent
Vuletic

(10) Patent No.: US 6,224,647 B1
(45) Date of Patent: May 1, 2001

(54) PROCESS AND DEVICE FOR CHARGING A FUSION GASIFIER WITH GASIFYING MEANS AND SPONGY IRON

(75) Inventor: Bogdan Vuletic, Duesseldorf (DE)

(73) Assignee: Deutsche Voest-Alpine Industrieanlagenbau GmbH (DE)

( * ) Notice: Subject to any disclaimer, the term of this patent is extended or adjusted under 35 U.S.C. 154(b) by 0 days.

(21) Appl. No.: 09/194,473

(22) PCT Filed: May 16, 1997

(86) PCT No.: PCT/DE97/01038

§ 371 Date: Feb. 19, 1999

§ 102(e) Date: Feb. 19, 1999

(87) PCT Pub. No.: WO97/46719

PCT Pub. Date: Dec. 11, 1997

(30) Foreign Application Priority Data

May 30, 1996 (DE) ..... 196 23 246

(51) Int. Cl.[7] ..... C21B 13/14

(52) U.S. Cl. ..... 75/381; 75/491; 75/492; 266/87; 266/160; 266/183

(58) Field of Search ..... 75/492, 381, 491; 266/87, 160, 183

(56) References Cited

U.S. PATENT DOCUMENTS

| | | | |
|---|---|---|---|
| 3,850,616 | 11/1974 | Cruse, Jr. . | |
| 3,908,072 | 9/1975 | Collin . | |
| 4,188,022 | 2/1980 | Beggs et al. . | |
| 4,286,775 | 9/1981 | Scarlett et al. . | |
| 4,296,775 | 10/1981 | Kagi et al. . | |
| 4,413,812 | 11/1983 | Pirklbauer et al. . | |
| 4,605,205 | 8/1986 | Langner et al. . | |
| 4,898,366 | 2/1990 | Vuletic . | |
| 6,086,653 * | 7/2000 | Joo et al. | 75/491 |

FOREIGN PATENT DOCUMENTS

| | | |
|---|---|---|
| 0 085 290 | 10/1986 | (EP) . |
| 0 094 707 | 10/1987 | (EP) . |
| 0 166 679 | 1/1988 | (EP) . |
| 0 299 231 | 7/1991 | (EP) . |
| 1087306 | 10/1967 | (GB) . |

* cited by examiner

*Primary Examiner*—Melvyn Andrews
(74) *Attorney, Agent, or Firm*—Marshall & Melhorn, LLC

(57) ABSTRACT

The invention relates to a device comprising a fusion gasifier and a reduction shaft arranged thereabove and for reduction of iron ore in spongy iron. The spongy iron is introduced through horizontal discharge devices in the lower section of the reduction shaft, and a pipe connection is introduced into the head section of the fusion gasifier where it is melted using a oxygen-containing gas and gasifying means also conveyed into the head of the fusion gasifier, and is reduced to liquid crude iron. A reduction gas is produced at the same time which is conveyed out of the head of the fusion gasifier. The discharge devices lead into a dust-blocking container arranged in a lower section of the reduction shaft and to which the pipe connection leading to the fusion gasifier is attached. The dust-blocking container is connected to a feed device for a seal gas at a higher pressure than the gas pressure in the head of the fusion gasifier thereby preventing gasifying gas from passing into the reduction shaft via the pipe connection. Humidity and volatile constituents have A already been removed from the gasifying means before introducton into the fusion gasifier as a result of mixing hot spongy iron with the gasifying means before the introduction thereof into the center of the gasifier head.

14 Claims, 1 Drawing Sheet

PROCESS AND DEVICE FOR CHARGING A FUSION GASIFIER WITH GASIFYING MEANS AND SPONGY IRON

BACKGROUND OF THE INVENTION

The invention relates to a process and device for coating a fusion gasifier with gasifying means and spongy iron.

DESCRIPTION OF THE PRIOR ART

Such a device is previously known from the documents DE 30 34 539 A1 and DE 37 23 137 Cl. The DE 30 34 539 A1 shows a fusion gasifier and a reduction shaft, which is arranged spaced and aligning toward the fusion gasifier. In the lower section of the reduction shaft a plurality of discharge devices being arranged star-like is provided therefrom in form of screw conveyors in a horizontal arrangement perpendicularly through the peripheral wall, which discharge the spongy iron from this lower section of the reduction shaft such that it is dispensed through the respective downpipes instantaneously into the fusion gasifier. For this purpose the downpipes terminate in the head section of the fusion gasifier in a centrical manner about the center line thereof being arranged spaced therefrom and to each other. In close proximity of the inlet connection piece of these downpipes in the gasifier head inlet openings for the gasifying means, preferably coal, are also placed as well as simultaneously the outlets for the reduction gas and crude gas, respectively, produced within the gasifier.

The fusion gasifier is directly connected to the reduction shaft through the downpipes. Hence, a great quantity of dust with such a gasifying gas being not dedusted enters into the reduction shaft through such downpipes. To reduce the total charge of dust into the reduction shaft and to limit the samples resulting therefrom, the main quantity of the gasifying gas is introduced as a reduction gas into the reduction shaft after dedusting inside a hot gas type cyclone dust separator at least 2 m above the screw conveyors of the discharge devices. The discharge in the reduction shaft between the port of the screw conveyors and the reduction gas inlet serves as gas obstruction means, hence the quantity of gasifying gas being not dedusted entering into the reduction shaft through the downpipes is limited. However, the larger the shaft diameter is, the larger this distance has to be. With a reduction shaft diameter of 5 m this distance is already more than 4 m. Because of this the reduction shaft becomes higher and heavier.

As a result of leading the screw conveyors in its radial arrangement into the perpendicularly extending wall portions in the lower section of the reduction shaft, a clearance volume results between the plane defined herewith inside the reduction shaft and the reduction gas inlet arranged thereabove, in which such a spongy iron is not reduced which does not participate in the process cycle which burdens it in an uneconomic manner. This clearance volume necessarily also increases the distance between the reduction shaft and the fusion gasifier arranged below and increases the weight of the reduction shaft as well as the total height of the plant. Another substantial disadvantage of this arrangement is a very low gas resistance of the piling up, which is predetermined by a large cross section of the reduction shaft in this portion, whereby an essential quantity of gas carrying a lot of dust flows from the fusion gasifier through the downpipes into the reduction shaft. Additionally, from this flowing up gasifying gas a great part of fine particles of the discharged spongy iron and calcined aggregates in case in the downpipes is sized and conveyed back to the reduction shaft such that the total charge of dust into the reduction shaft still becomes increased. Particularly disadvantageous coal particles, which pass from the close gasifying means inlets into the downpipes and which contain because of its short residence time in the gasifier a portion of volatile constituents and tar, which in the lower section of the reduction shaft as a binder can result in a bridging and nodulizing as well as an uncontrolled discharge of the screw conveyors.

It was also found that having this arrangement with charging the fusion gasifier, a uniform distribution and mixing between the gasifying means and the spongy iron within the region of the gasifying bed is not insured at least or can not be satisfactorily assured. This inhomogeneous charging becomes disadvantageously apparent in particular in the center of the gasifier and during an unsteady operation of the fusion gasifier with great variations of the gas quantities and the pressure of the plant as well as in front of the single oxygen nozzles, if one of such spongy iron conveyor devices fails and only acid slag from coal ash without spongy iron and aggregates is melted. Further disadvantages of this arrangement are a great wear of the lining in the downpipes and the necessity of emptying the reduction shaft during greater repairs with the conveying devices. Because of this, longer lasting losses of production occur as well as high starting costs. Because of the fact that the conveyor devices are only one-side supported, a further limitation of the size and the effectivity of the general plant is given.

With the device according to the document DE 37 23 137 C1 a plurality of the above mentioned problems are solved or alleviated. The problem of such a still relatively high charge of dust via the pipe connections to the reduction shaft and the following problems associated therewith, which all of the reduction melting processes have to contend with, however, are not yet satisfactorily solved with this device as well. During normal operation a greater portion of dust is indeed separated inside the connection shafts between the discharge devices and the reduction shaft in the piling up such that less dust passes into the reduction shaft, however covering with dust of the piling up within the connection shafts further remains increased, whereby such a piling up in this region relatively easily tends in hanging. With a more highly dusting of the furnace piling up in the reduction gas inlet region, the so called bustle region of the reduction shaft, the pressure difference increases between the fusion gasifier and the lower region of the reduction shaft and accordingly the flowing up quantity of the gasifying gas increases being not dedusted via the connection shafts and, according to the DE 30 34 539 A1 modification, via the downpipes, respectively, toward the reduction shaft. This effect is still increased in that the gasifying gas includes a direct access to the relatively not dedusted piling up in the center of the reduction shaft via the downpipes and connection shafts, respectively, as well as the discharge devices. Hence, the effect of an air separation in the dome cap of the gasifier and in the downpipes, respectively, also becomes stronger and stronger, the dust content of the flowing back gas becomes higher and higher, and the piling up inside the connection shafts as well as in the lower section of the reduction shaft is allowed to be concentrated with this cycle dust, such that due to high friction forces in the piling up very low pressure differences are sufficient to cause hanging of the piling up in the connection shafts and the lower part of the reduction shaft, whereby the well-known phenomenons of chanelling and undisturbed gas flow having a high dust content occur from the fusion gasifier toward the reduction shaft. Such cases happen when too much fine dust is charged with the coal by employing a greater quantity of coal in the coal mixture, which highly disintegrates at high temperatures if extremely high temperatures appear in the gasifier, which result in a greater disintegration of coal as well as with greater disintegration of ore in the reduction shaft and with a failure and partly failure of the dust recirculation. In such cases still more problems can appear by the recirculated dust with the embodiment according to FIG. 1 of the DE 37 23 137 C1 than with the device according to the DE 30 34 539 A1 since by the addition of gasifying means and coal as well as spongy iron, respectively, via a common dome cap, in which highly lower temperatures are present than within the dome of the fusion gasifier, wherein such a gasifier dust predominantly includes not dedusted and tar containing coal particles which result in nodulizing and bridging. These bridgings can be removed relatively more difficult than in the lower section of the reduction shaft with its great cross section.

With the embodiment according to FIG. 2 of the DE 37 23 137 C1 the dust contains less coal particles, however, the problems are similar therewith.

A device comprising a fusion gasifier and a reduction shaft arranged thereabove and for reduction of iron ore in spongy iron is also known from the U.S. Pat. No. 4,286,775. At the lower end of the reduction shaft the spongy iron drops upon a horizontal conveyor belt and is conveyed by this conveyor belt to a perpendicular pipe connection through which it passes into the head of the fusion gasifier. Therein it is melted by means of gasifying means in form of finely milled coal as well as oxygen which are immediately introduced above the melting charge, and is reduced to liquid crude iron, wherein at the same time reduction gas is produced. This reduction gas is conveyed out of the head of the fusion gasifier and blown therein after dedusting and cooling in the central height of the reduction shaft. Hence, to cause as little as possible of dust loaded reduction gas to pass directly from the fusion gasifier into the reduction shaft via the vertical pipe connection, a dust-blocking means is provided in the lower section of the reduction shaft, which is adapted such that a seal gas is fed at a higher pressure than the gas pressure within the head of the fusion gasifier.

Feeding the solid gasifying means directly above the melting charge requires the use of finely milled coal. This presupposes a respective preparatory treatment of the coal and also requires a definite quality of the coal. Because of this the running costs of the known device is relatively high.

SUMMARY OF THE INVENTION

Hence, it is the object of the present invention for the known device comprising a fusion gasifier and a reduction shaft arranged thereabove and for reduction of iron ore in spongy iron which is introduced through horizontal discharge devices in the lower section of the reduction shaft and a pipe connection into the head of the fusion gasifier where it is melted using gasifying means and an oxygen-containing gas also conveyed into the fusion gasifier, and is reduced to liquid crude iron, wherein at the same time a reduction gas is produced which is conveyed out of the head of the fusion gasifier, which device comprises in the lower section of the reduction shaft a dust-blocking means with a feed device for a seal gas at a higher pressure than the gas pressure in the head of the fusion gasifier, to be improved such that coal having a wide graining range, i.e.untreated coal and moreover having a relatively poor quality can be charged as a gasifying means.

This object is solved according to the invention by the features indicated in the characterizing portion of claim 1. Advantageous improvements of the device according to the invention as well as a preferred embodiment by using this device result from the dependent claims.

BRIEF DESCRIPTION OF THE DRAWING

In the following the invention is explained in more detail according to an embodiment shown in the Figure. This Figure. shows a vertical section through a device according to the invention.

DESCRIPTION OF THE PREFERRED EMBODIMENT

Figure 1:
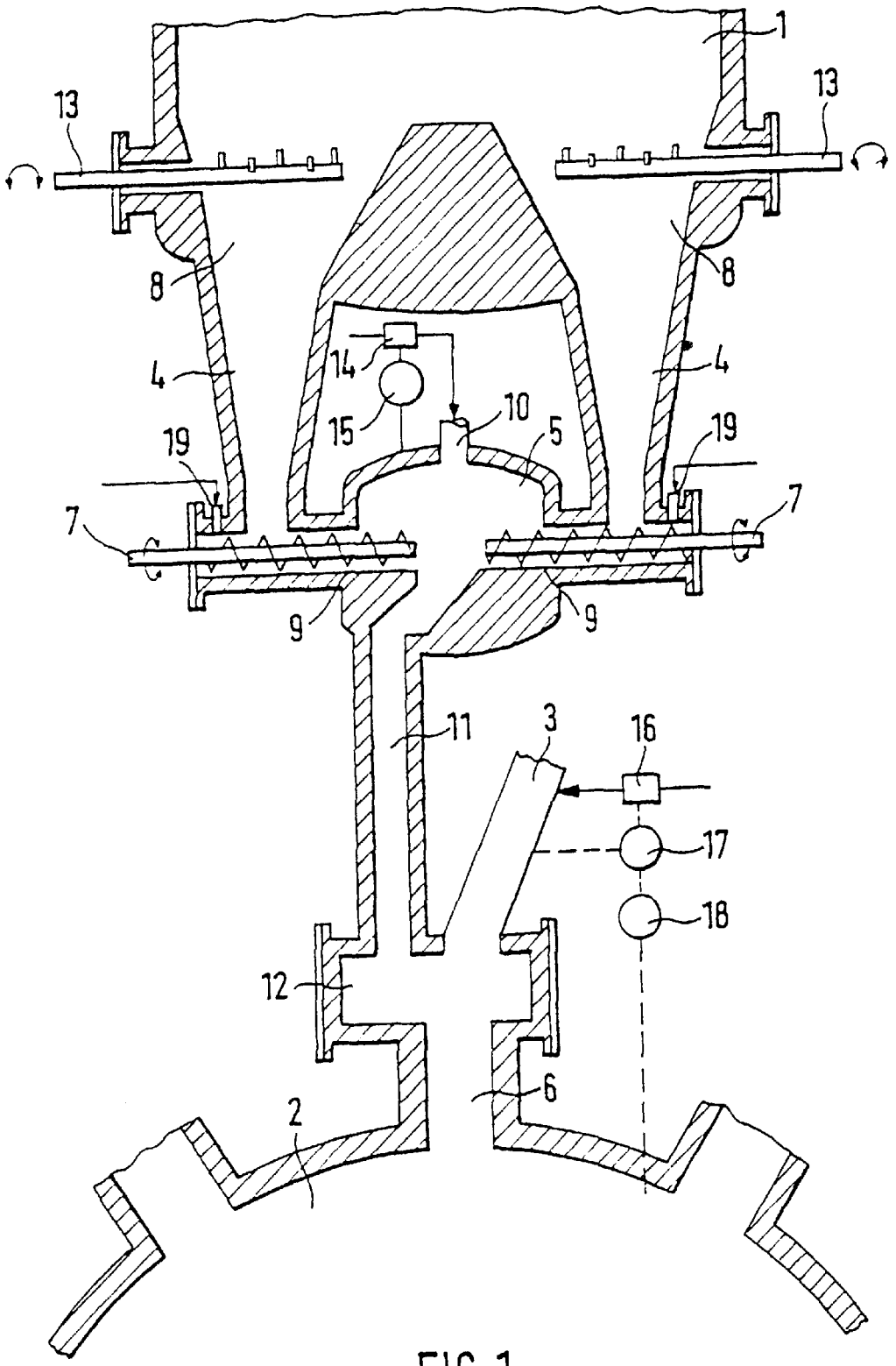

A reduction shaft 1 is only outlined with respect to its lower bottom portion, whereas a fusion gasifier 2 is limited to the illustration of its upper portion. The preferably funnel-shaped connection shafts 4 being substantially vertically arranged between the reduction shaft 1 and a dust-blocking container 5, lead directly into the horizontal or slightly curvedly formed bottom of the reduction shaft 1. Only two connection shafts 4 are reproduced in the sectional view, however, a plurality of such connection shafts are arranged in a well-known manner on the perimeter of a circle, which center forms the longitudinal axis of the reduction shaft 1. Screw conveyors of discharge devices 7 are star-like, horizontally with respect to the longitudinal axis of the dust-blocking container 5 and the reduction shaft 1, respectively, in the radial direction, and connect the connection shafts 4 from the reduction shaft 1 having inlets 9 of the dust-blocking container 5, from which discharged spongy iron is immediately discharged via the downpipe 11 to a mixing container 12. The dust-blocking container 5 is charged with seal gas within the upper portion via at least one inlet 10 and/or via one inlet 19 of the single discharge devices 7, in order to maintain some excess pressure therein with respect to the pressure within the fusion gasifier 2 such that the charge of dust via the downpipe 11 in the reduction shaft 1 is stopped. Washed and cooled gasifying gas is normally used as a seal gas. With the most iron ore reduction melting processes this gas serves to adjust the temperature of the reduction gas.

The charge of gasifying means is achieved by means of an inlet 3 arranged on the mixing container 12 at a steep angle. This inlet 3 is cooled by feeding a cooling gas via a controller 16 controlled by one of the temperature measuring means 17 and 18 to avoid tar deposits and a deposit forming in the inlet 3. By means of this feeding a cooling gas the cooling gas is supplied via the mixing container 12 into the dome of the fusion gasifier 2 as well if therein excessive high temperatures occur caused by the failure of coal charging, an inappropriate ratio of oxygen quantity to melting performance or due to other reasons. Increased temperatures in the dome portion of the fusion gasifier 2 increase the disintegration of coal having a highly detrimental effect to the operation of the fusion gasifier 2 and the reduction shaft 1, since smaller graining and finer dust having a greater quantity originate therefrom, the separating capacity of the hot gas type cyclone dust separator for dedusting gasifying gas becomes more deteriorated and thus besides a greater dust quantity via the downpipe 11 substantially more dust passes via the bustle passage into the reduction shaft 1 as well and the pillng up dusts rapidly. In such cases the control of the quantity of cooling gas is carried out by the temperature measuring instrument 18.

The mixing container 12 is directly arranged above the fusion gasifier 2. The mixture of the hot spongy iron and cold gasifying means is immediately supplied from the mixing container 12 via an inlet 6 into the center of the fusion gasifier 2.

In the inlet region of the connection shafts 4 or bridge breaker 13 mounted above thereof prevent the introduction of larger nodulizings into the connection shafts 4. Thereby, piling up within the connection shafts 4 is released from weight of the above column of material and loosened such that bridging is avoided. If required, also in the lower section of the connection shafts 4 an additional bridge breaker 13 can be mounted. The single bridge breakers 13 are each reciprocated about approximately 30° by means of a hydraulic cylinder.

The employment of the dust-blocking container 5 enables the direct connection of each discharge device 7 with the fusion gasifier 2 to be substituted by the common downpipe 11. Thereby, the number of connections decreases from about six to eight toward one pipe connection. Independently of the size of the plant it also enables to employ shorter and thus more rugged and cheaper discharge devices 7 having lower need of maintenance, which can also be exchanged without problematic and expensive discharging the reduction shaft 1. During an exchange the screw conveyor can be rotated and then pushed into a relatively small heap of material. In the upper region of the dust-blocking container 5, a manhole cover is commonly provided such that the inspection and rapid exchange of these important devices become possible, which continuous operation may only be abandoned with great disadvantages with respect to the operation of the general plant.

By feeding the seal gas via the controller 14 and the pressure difference measuring device 15 above the at least one inlet 10 into the upper region of the dust-blocking container 5 and/or via the inlets 19 into the upper region of the single discharge devices 7 some excess pressure related to the pressure in the fusion gasifier 2 is maintained in the feeding region and hence the charge of dust from the fusion gasifier 2 into the reduction shaft 1 is stopped. Moreover, the fine particles discharged with the spongy iron are no longer separated by the flowing up gasifying gas and conveyed back to the reduction shaft 1, but are displaced towards the fusion gasifier 2 by the downward directed flow of a part of said seal gas. Thereby, in normal operation, the charge of dust into the reduction shaft 1 is reduced in comparison with the known reduction shafts by one quarter to one third, and is substantially more reduced in problem cases, whereby a more rugged and more stable manner of operation of the reduction shaft and the general plant are ensured. Without coal particles and gasifying dust affecting as a binder in the reduction shaft, firm nodulizings are no longer formed within the lower section of the reduction shaft 1, wherein a stable operation of the conveyor means with constant conveying speed is given without them at a continuous decrease of the dusting of the piling up in the lower region of the reduction shaft 1.

The mixing container 12 mounted between the dust-blocking container 5 and fusion gasifier 2 are used for mixing spongy iron and gasifying means which results in several advantages. By charging the spongy iron and gasifying means over the common inlet 6 separate six to eight inlets for the spongy iron and a large dome cap can be omitted, whereby lining within the large dome region of the fusion gasifier 2 can be more stable and easier constructed. By an advantageous arrangement of the dust-blocking container 5 and mixing container 12 which are each provided with wear pockets it is obtained for the spongy iron and partly gasifying means as well to be fallen upon a material pad, whereby wear of the lining is decreased. The obliquely arranged inlet 3 partly directs the material flow of the gasifying means upon a material pad and partly against the material flow of the mixture sliding downward. Because of this such two material flows are mixedly delivered towards the center of the fusion gasifier 2 and the wall of inlet 6 against which the material flow being directed is protected from wearing by the spongy iron layer flowing off downward and the mixture, respectively. Since the gasifying means thus practically does not contact the hot lining wall upon which tar and dust deposits could be formed, with this advantageous improvement one can renounce the water cooled lining at the inlet 6 which is usually indispensable with a separate feeding of gasifying means. Thereby, a unit omits which withdraws the heat from the fusion gasifier 2 and which has to be substituted in longer time periods because of the wear or breakage of the weld seams. With separate charging the coal into the center of the gasifier and spongy iron into an outer ring as is the case in the known devices, more coarse coal particles slide to the outside and the fine particles remain in the center which is also worse gas-operated and remains colder. If a greater quantity of coal having a smaller graining then slides off from the colder center of the gasifier bed into the greater gas-operated and more heated outer ring, in which it is rapidly degassed by such high available heat of the gasifier bed and the ascending gas, a rapid increase of the produced gas quantity and pressure, respectively, and hence an unsteady operation of the general plant are affected. The smaller such coal is the more it rapidly degasses and reinforces the above described operations. By mixing the spongy iron and gasifying means within the mixing container 12 and by a common discharge of the mixture into the center of the fusion gasifier 2, degassing of the residual humidity and a great portion of volatile constituents of the coal in the worse gas-operated center of the gasifier is obtained before the mixture slides off from the colder center of the gasifier bed into the greater gas-operated and more heated outer ring. The common charge with the hot and heavier spongy iron particles which thereby sojourn longer in the center together with the small coal and affect its degasifying, provides for more motion and less segregation, whereby the voide volume of the gasifier bed and the gas flow in the central region increase and this region becomes more heated. If also greater quantities of small coal slide off from the center of the gasifier into the heated outer ring, less gas is produced, since the mixture contains much less coal being previously degassed to a great extent than with coal charging via a separate inlet. Another advantage results from more uniform conditions in the melting region of the single oxygen nozzles. Even though one of the discharge devices 7 only restrictedly conveys or totally fails or discharges worse reduced spongy iron and less calcined aggregates, with common charging of spongy iron and gasifying means through the center of the gasifier, an almost uniform mixture of degassed coal, spongy iron and calcined aggregates passes toward the melting region of each single oxygen nozzle. Hence, previous mixing of spongy iron and gasifying means in the mixing container 12 and common charging into the center of the fusion gasifier is extraordinarily important for a steady and stable operation of the fusion gasifier and the general plant.

By temperature controlled feeding the dedusted cooling gas via the controller 16 and the thermometer means 17 occurring of tar precipitations and occlusions if any within the inlet 3 for the gasifying means is avoided. As previously mentioned, this controlled cooling gas feeding is also used with excessive temperatures within the dome of the fusion gasifier 2 for a controlled cooling therein. In this case, more cooling gas is supplied via the inlet 3 than being required for its cooling, and the control of the cooling gas quantity is achieved via the thermometer means 18 mounted in the dome of the fusion gasifier 2.

By feeding the seal and cooling gases each from above and via pipe conduits placed with descending gradient a possible occlusion of these pipe conduits is avoided.

As a result of connecting the discharge devices 7 for the spongy iron to the fusion gasifier 2 only through a common connection comprising the dust-blocking container 5, downpipe 11, mixing container 12 and gasifier inlet 6, an overall cross section of the connection between the fusion gasifier and reduction shaft is highly reduced. The number of connections decreases from six to eight toward only one downpipe having an unessentially greater cross section than that of the single connections, since the cross section is not determined by the discharged quantity of the spongy iron and the aggregates, but is determined by the size of subjects being allowed to block the downpipe. A great total quantity of the spongy iron and aggregates discharged through this relatively small cross section generates such a high pumping effect by free descent such that a very small quantity of seal gas directed toward the inlet 10 of the dust-blocking container 5 is sufficient to stop the gasifier gas flow toward the reduction shaft 1. The bridge breakers 13 above each discharge device 7 and above each and/or inside each preferably funnel-shaped connection shaft 4, respectively, on the one hand, perform the task to release piling up in the respective connection shaft 4 from weight of the above column of material and thereby to loosen up such that bridges cannot be formed beneath and, on the other hand, to destroy nodulizings in case of forming thereof above such bridge breakers 13 during a standstill. The distance between a bridge breaker 13 and inlet 8 of the associated connection shaft is chosen such that the dimensions of the greatest nodulizings which are allowed to pass through this region are smaller than the diameter of the narrowest location of the connection shafts 4.

What is claimed is:

1. Device comprising a melting gasifier (2) and a reduction shaft (1) arranged thereabove and for reduction of iron ore in spongy iron, which is introduced through horizontal discharge devices (7) in the lower section of the reduction shaft (1) and a pipe connection (11) into the head of the melting gasifier (2) where it is melted using a gasifying means also conveyed into the melting gasifier (2) and an oxygen-containing gas, and is reduced to liquid crude iron, wherein a reduction gas is produced at the same time which is conveyed out of the head of the melting gasifier (2), wherein said device in the lower section of the reduction shaft (1) comprises a dust-blocking means with a feed device (10) for a seal gas at a higher pressure than the gas pressure in the head of the melting gasifier (2), characterized in that said discharge devices (7) lead into a dust-blocking container (5) arranged in a lower section of the reduction shaft (1) and to which the pipe connection (11) leading to the melting gasifier (2) is attached and which is connected to the feed device (10) for a seal gas, and that a mixing container (12) is provided at the gasifier side end of said pipe connection (11) which comprises an additional inlet (3) for the gasifying means.

2. Device according to claim 1, characterized in that said mixing container (12) includes an outlet which is connected in close proximity to an inlet (6) in the center of the head of the melting gasifier.

3. Device according to claim 1, characterized in that said pipe connection between said reduction shaft (1) and said melting gasifier (2) is a downpipe (11).

4. Device according to claim 1, characterized in that the lower section of said reduction shaft (1) leads into vertical connection shafts (4) being annularly arranged on the inside of the outer wall of said reduction shaft (1) at which lower end a respective discharge device (7) is positioned.

5. Device according to claim 4, characterized in that a respective bridge breaker (13) is provided at the upper end of said connection shafts (4).

6. Device according to claim 1, characterized in that said discharge device (7) comprises on its outside a respective inlet (19) for feeding the seal gas.

7. Device according to claim 1, characterized in that said additional inlet (3) for the gasifying means in the mixing container (12) is connected to a cooling gas source.

8. Device according to claim 7, characterized in that within the pipe connection between the cooling gas source and the additional inlet (3) for the gasifying means a controller (16) controlled by a thermometer means (17, 18) is provided.

9. Device according to claim 1, characterized in that said feed device for the seal gas comprises a pressure difference measuring means (15) and a controller (14).

10. A process for charging a melting gasifier (2) with sponge iron from a reduction shaft (1) and with gasifying means by using a device of said melting gasifier (2) and said reduction shaft (1) arranged thereabove and for reduction of iron ore to sponge iron which is introduced through horizontal discharge devices (7) in the lower section of said reduction shaft (1), and a pipe connection (11) is introduced into the head of said melting gasifier (2) where it is melted using gasifying means also conveyed into the head of the melting gasifier (2) as well as an oxygen-containing gas, and is reduced to liquid pig iron, and at the same time a reduction gas is produced which is conveyed out of the head of the melting gasifier (2), wherein the discharge devices (7) lead into a dust-blocking container (5) arranged in a lower section of said reduction shaft (1) and to which the pipe connection (11) leading to said melting gasifier (2) is attached, and said dust-blocking container (5) is connected to a feed device (10) for a seal gas at a higher pressure than the gas pressure in the head of said melting gasifier (2), characterized in that the sponge iron in the lower section of said reduction shaft (1) is conveyed by said discharge devices (7) into a dust-blocking container (5), in which a seal gas at a higher pressure than the gas pressure in the head of the melting gasifier (2) is generated, and that the sponge iron and said gasifying means are mixed with each other and introduced therein in the center of the head of said melting gasifier (2) before its introduction into said melting gasifier (2).

11. A process according to claim 10, characterized in that a cooling gas is added to said gasifying means before its mixing with the spongy iron.

12. A process according to claim 11, characterized in that feeding the seal gas and the cooling gas is respectively achieved from above and through pipe conduits placed with descending gradient.

13. A process according to claim 12, characterised in that a cooling gas is added to said gasifying means before its mixing with sponge iron.

14. A process according to claim 13, characterised in that feeding a seal gas and cooling gas is each achieved from above and through pipes having descending gradient.

* * * * *